US006237787B1

(12) United States Patent
Gallo et al.

(10) Patent No.: US 6,237,787 B1
(45) **Date of Patent: *May 29, 2001**

(54) PACKAGING SYSTEM FOR STORING AND DISPENSING PRODUCTS

(75) Inventors: Anthony B. Gallo, Warren; Stephen John Mohary, Pennington, both of NJ (US); Ivan Chan, Chai Wan (HK)

(73) Assignee: Johnson & Johnson Consumer Products, Inc., Skillman, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/662,547

(22) Filed: Jun. 13, 1996

(51) Int. Cl.[7] ..... B65D 1/32; B65D 23/02
(52) U.S. Cl. ..... 215/12.1; 206/457; 222/105
(58) Field of Search ..... 215/12.1, 12.2, 215/11.6, 10; 206/277, 457; 222/105, 95

(56) References Cited

U.S. PATENT DOCUMENTS

| | | | | |
|---|---|---|---|---|
| D. 24,750 | | 10/1895 | Vail . | |
| D. 155,005 | | 8/1949 | Graham | D58/9 |
| D. 255,813 | | 7/1980 | Pape et al. | D21/166 |
| D. 256,989 | | 9/1980 | Kirchen | D9/32 |
| D. 274,219 | | 6/1984 | Fieldhouse | D9/316 |
| D. 296,060 | | 6/1988 | Wilkinson | D6/542 |
| D. 302,244 | | 7/1989 | North | D9/310 |
| D. 314,340 | | 2/1991 | Waugh | D9/455 |
| D. 318,223 | | 7/1991 | Allen | D9/320 |
| D. 334,889 | | 4/1993 | Condemi et al. | D9/455 |
| D. 348,831 | | 7/1994 | Elam | D9/311 |
| D. 353,323 | | 12/1994 | Meng | D9/307 |
| D. 364,800 | | 12/1995 | Drewes et al. | D9/310 |
| 995,700 | * | 6/1911 | Maynard | 215/11.6 X |
| 1,121,349 | | 12/1914 | Goss . | |
| 1,210,892 | | 1/1917 | Borchmann . | |
| 1,375,480 | * | 4/1921 | West | 150/154 |
| 1,589,138 | * | 6/1926 | Fisk | 215/11.6 |
| 1,690,509 | * | 11/1928 | Thoreson et al. | 215/11.6 |
| 1,772,339 | * | 8/1930 | Cole | 215/11.6 |
| 2,078,400 | * | 4/1937 | Maupin | 150/154 |
| 2,150,835 | * | 3/1939 | Kazimirow | 215/11.6 |
| 2,484,776 | | 10/1949 | Zent et al. | 229/8 |
| 2,490,250 | * | 12/1949 | Boener | 150/154 |
| 2,532,729 | | 12/1950 | Millstein | 46/11 |
| 2,704,903 | | 3/1955 | Laughlin | 41/10 |
| 2,994,448 | * | 8/1961 | Sepe et al. | 215/11.6 X |
| 3,105,612 | | 10/1963 | Krasnoff et al. | 215/12.1 X |

(List continued on next page.)

FOREIGN PATENT DOCUMENTS

| | | | | |
|---|---|---|---|---|
| 2122184 | * | 11/1972 | (DE) | 206/457 |
| 8612862 | | 8/1986 | (DE) . | |
| 0 609 575 A1 | | 8/1994 | (EP) . | |
| 545900 | * | 10/1922 | (FR) | 215/12.1 |

(List continued on next page.)

*Primary Examiner*—Sue A. Weaver
(74) *Attorney, Agent, or Firm*—Michele G. Mangini

(57) ABSTRACT

A packaging system for storing and dispensing liquid or powder products. The product is housed within an inner container having a body defined by a side wall and an opening therein for dispensing the product. A flexible outer shell substantially surrounds the inner container and is removably secured thereto. The outer shell can be designed to resemble the three-dimensional shape of an animal, cartoon character or the like, for superior aesthetic appeal. The contents of the inner container may be sealed with a closure. A three dimensional topper may be provided, which is designed to resemble the head or upper portion of the character being depicted. The outer shell can be squeezed to cause dispensing of the product from the inner container, and can be adapted to hold inner containers of all shapes and sizes. The inner container is easily replaced once empty.

2 Claims, 13 Drawing Sheets

U.S. PATENT DOCUMENTS

| | | | | |
|---|---|---|---|---|
| 3,120,319 | * | 2/1964 | Buddrus | 215/12.2 |
| 3,178,060 | * | 4/1965 | Bossack | 222/78 |
| 3,313,455 | * | 4/1967 | Kemmer | 206/277 X |
| 3,450,254 | * | 6/1969 | Miles | 215/12.2 X |
| 3,507,416 | | 4/1970 | Douglas et al. | 215/12 |
| 3,837,111 | | 9/1974 | Godfrey et al. | 46/11 |
| 3,868,036 | * | 2/1975 | Wittwer | 215/12.1 |
| 4,510,769 | | 4/1985 | McClellan, Jr. | 62/457 |
| 4,549,410 | | 10/1985 | Russell | 62/457 |
| 4,568,298 | | 2/1986 | Acree | 446/74 |
| 4,607,674 | * | 8/1986 | Noble | 150/154 X |
| 4,708,254 | | 11/1987 | Byrns | 215/13.1 |
| 4,815,999 | | 3/1989 | Ayon et al. | 446/73 |
| 4,816,000 | | 3/1989 | Hsu | 446/74 |
| 4,850,496 | * | 7/1989 | Rudell et al. | 215/11.6 X |
| 4,867,214 | | 9/1989 | Fuller | 428/35.8 |
| 4,944,704 | | 7/1990 | Grace | 446/74 |
| 4,961,717 | * | 10/1990 | Hickey | 206/457 X |
| 5,088,611 | | 2/1992 | Katz | 215/230 |
| 5,088,948 | * | 2/1992 | Scheurer | 215/902 X |
| 5,386,909 | | 2/1995 | Spector | 206/457 |
| 5,390,804 | | 2/1995 | Beggins | 215/12.1 X |
| 5,454,486 | | 10/1995 | Mack et al. | 222/95 |
| 5,480,044 | | 1/1996 | Nosser | 215/228 |
| 5,489,050 | * | 2/1996 | Finkiewicz et al. | 222/78 X |
| 5,531,349 | | 7/1996 | Wojcik et al. | 220/339 |
| 5,614,275 | | 3/1997 | Chan et al. | 428/35.7 |
| 5,636,740 | * | 6/1997 | Finkiewicz et al. | 206/457 |
| 5,738,232 | * | 4/1998 | Roberts et al. | 215/12.1 X |

FOREIGN PATENT DOCUMENTS

| | | | | |
|---|---|---|---|---|
| 391756 | * | 7/1931 | (GB) | 215/11.6 |
| 766082 | * | 1/1957 | (GB) | 215/11.6 |
| 817381 | | 7/1959 | (GB) . | |
| 2 289 009A | | 11/1995 | (GB) . | |
| 4046057 | * | 1/1992 | (JP) | 206/457 |
| 9105717 | * | 5/1991 | (WO) | 206/457 |
| WO94/17982 | | 8/1994 | (WO) . | |
| WO96/06016 | | 2/1996 | (WO) . | |

* cited by examiner 23
22
21
26
27
24
28
30
20
32

PACKAGING SYSTEM FOR STORING AND DISPENSING PRODUCTS

FIELD OF THE INVENTION

The present invention relates generally to packaging systems for storing and dispensing products. More specifically, it relates to a packaging system that comprises an inner container which holds the product, surrounded by a flexible outer shell removably attached to the inner container. The flexible outer shell can be molded in a three-dimensional form to resemble an animal, cartoon character, youngster's toy or the like. Once the product is completely used, the inner container is removed from the outer shell and replaced with a new, full inner container.

BACKGROUND OF THE INVENTION

Various containers for storing and/or dispensing liquid or powder products, which have been modified to display a decorative external appearance, are known in the art. Many of these containers have further been provided with three-dimensional components to provide a shape to the container that resembles an object, such as an animal or a cartoon character. Such modifications are designed to enhance the container's aesthetic appearance, making the container more suitable for display in one's home, such as on the bathroom sink or on the kitchen counter. Also, if the container, such as a bottle of shampoo for example, is made to resemble a cartoon character or the like, it may decrease a child's fear or displeasure of having his or her head shampooed.

The earliest decorative containers of this type included bottles which were formed by blow molding. Thereafter, a pressure sensitive label or shrink label was applied as decoration to these bottles, which typically contained bath soaps, shampoos and bubble baths. These bottles were provided with cartoon character heads, or "toppers" as they are known in the art. The topper was placed over the bottle's closure and secured thereto such as by friction fitting or the like. Many of these toppers were provided with an opening therein, to allow for dispensing of the product through the topper. Other toppers merely housed the dispensing device, and had to be removed to gain access to the dispensing device.

Although these designs provided the package with a decorative appearance, the actual character depicted was merely a one dimensional label applied to the bottle itself. Any features with three-dimensional detail were limited to the decorative toppers.

One such early decorative container known in the prior art is hollow, generally cylindrical in configuration and comprises a peripheral side wall. The container is closed at its bottom end and terminates at its upper end in a neck portion. The container further comprises a two-piece closure, known in the art as a "push-pull" closure, for sealing the contents, such as a liquid or powder, within the container. The two piece closure comprises an inner cap and an outer fitment. The inner cap has a hollow, reduced diameter spout which is closed at its top and has a circumferential sealing bead located below the top. The spout further includes at least one opening therein which is located between its closed top and the circumferential sealing bead. The outer fitment is hollow and has an upwardly extending, reduced diameter portion whose top is open. The fitment also has a peripheral sealing bead on the internal surface of its reduced diameter portion. To seal the container and it contents, the inner cap is secured, generally with the use of threads, over the neck portion of the container. The fitment is then pushed into place over top of the inner cap so that the internally located sealing ring of the outer fitment is located below the externally located sealing bead of the inner cap, and the external surface of the uppermost portion of the spout of the inner cap comes into sealing engagement with the inner surface of the upwardly extending, reduced diameter portion of the external fitment. A hollow decorative piece, i.e., the "topper," may be secured to the fitment where it can be held in place by, e.g., friction fit. When a topper is used, it will have an opening therein for receiving the reduced diameter spout of the fitment. To dispense the contents of the container, the fitment (and its overlying topper, if one is used) is pulled upwardly. This removes the spout of the inner cap from its sealing engagement with the inner surface of the reduced diameter portion of the fitment. The contents may then flow from the interior of the container, through the interior of the reduced diameter spout of the inner cap, through said at least one opening in the spout, and finally through the open upper end of the fitment. The side wall of the container is either a rigid material, in which case the contents would be poured out of the container, or the side wall is flexible, in which case the contents may be dispensed by squeezing the wall.

The above-described prior art container provides three-dimensional characteristics only in the topper area, and is thus not as aesthetically pleasing as a container having three-dimensional detail over the entire body of the container. The main portion of the bottle is simply cylindrical, with a two-dimensional label or picture showing the lower body of the figure or character attached to the outer surface of the container. Further, this container does not allow for the replacement of the bottle. Once the product is completely used, the container either has to be disposed of, and a new container purchased, or a refill of the product has to be purchased and then placed into the container, such as by pouring, etc.

Another container, known in the prior art and somewhat similar in design to the above-described container, is again generally cylindrical in configuration and comprises a peripheral side wall and a bottom. The neck portion of this container is elongated, and a closure such as a standard pump dispenser or spray fitting is attached to the neck portion, generally with the use of threads, to seal the contents of the container. The sidewall of the container is formed from a flexible material, and is provided with a two-dimensional label as decoration.

A decorative topper is fitted over the pump or spray dispensing closure and then moved firmly into place about the elongated neck portion. The topper is held in place by means of cooperating sealing beads on the outer surface of the elongated neck portion and inner surface of the topper. The topper is provided with an opening or aperture in both its top and its bottom, to allow for the slidable placement of the topper over the dispensing closure and onto the neck portion. Thus, unlike the previously mentioned container, this container does not provide for dispensing of the product through the topper itself—rather, the dispensing portion, i.e., the closure, extends through the opening in the top of the topper. However, this container still suffers from the same shortcomings, namely, any three-dimensional detail is limited to the topper provided on the upper portion of the container, and the container is therefore not as aesthetically pleasing. Also, the container is not replaceable, requiring the purchase of an entire new container or a refill. Refilling tends to be a cumbersome procedure, requiring the disassembly of the existing container, followed by pouring the refill product into the container, and then reassembly of the container. Often times the topper is fixably secured to the bottle, such that it is virtually impossible to remove the topper for refilling without damaging or destroying the container.

Another container known in the prior art is similar in design to the first-mentioned prior art container, in that in consists of a flexible container having a push-pull type closure and a decorative three-dimensional topper affixed to the closure, through which the contents of the container are dispensed. However, the lower portion of the container, rather than being simply cylindrical, is instead molded to provide minimal three-dimensional characteristics, e.g., the outer shape of a cartoon character or the like. A printed label or the like portraying the appearance of the cartoon character is then placed over the shaped bottle to provide the decoration. This container is therefore somewhat more aesthetically pleasing than a cylindrical bottle having only a three-dimensional topper thereon. Nevertheless, this container still does not provide a replaceable-type bottle, and possesses very limited three-dimensional characteristics.

Other containers known in the prior art consist of bottles which are formed from rigid thermoplastic polyvinylchloride (PVC), and are blow molded to have the three-dimensional shape of the body portion of, e.g., a cartoon character or the like. These containers generally terminate in a neck portion, which is provided with threads and sealed with a threaded cap. Rigid PVC is used so that the three-dimensional body portion of the bottle can be painted for decoration. Upon painting, the solvent in the paint may attack the PVC. Therefore, the walls of the rigid PVC container must be relatively thick, to enable the container to maintain its structural integrity and adequately contain the product. Typically a three-dimensional topper resembling the head portion of the character, similar to the toppers previously discussed and formed from a flexible PVC material, is friction-fitted over the threaded cap which seals the bottle.

Although designs such as these provide containers for liquid products which resemble three-dimensional character shapes, these containers do not physically separate the character shape from the product, i.e., the inner surface of the container generally matches the shape of the outer, three-dimensional surface. Because of this lack of separation, the character shape has to be constructed from a material which does not chemically interact with the product being contained. This restriction tends to prevent the use of soft, flexible materials for the character shape. Flexible materials used to manufacture product containers typically contain plasticizers, which may react with the product in the container and lead to deleterious effects. Since rigid materials are used to construct the container, the character shapes possess relatively crude three-dimensional characteristics. Further, the container, being rigid, cannot be squeezed to cause dispensing of the product. Therefore, only a traditional threaded cap, or a pump or spray-type device, can be used as the closure. Dispensing closures such as flip top or disk top closures, cannot be used since the rigid container cannot be squeezed to dispense its contents therefrom. Additionally, these containers are not replaceable—refilling is necessary once the product supply is exhausted.

The body or lower portion of these containers is produced by extrusion blow molding, using split molds. This process, while allowing for minimal three-dimensional detail, cannot provide the negative drafts necessary to produce undercuts on the finished product. Undercuts is a term known by those skilled in the art to describe the shapes and surfaces of a product having a true three-dimensional look, e.g., objects such as a ball or the like, being held by the figure or character depicted, can be made to appear more nearly spherical, rather than merely hemispherical. The decorative toppers, by comparison, are produced by rotationally molding a plasticized PVC resin. This process does allow for the negative drafts which produce undercuts, and hence, superior three-dimensional detail. The topper, unlike the lower portion of the container, can be made from a flexible material and rotationally molded because the topper does not contain, or come into contact with, the product being stored, and therefore does not pose a risk of chemical interaction with or adulteration of the product.

Yet another container known in the prior art consists of a replaceable, thin walled, inner bottle enclosed within a two-piece outer housing having a three-dimensional, decorative character shape. The inner bottle is blow molded, and is shaped to conform to the three-dimensional shape of the outer housing. The outer housing is a shaped, injection molded, rigid plastic shell, which consists of two cooperating shell halves. The inner bottle is placed within the two rigid shell halves, which snap-fit together to hold the inner bottle in place. The inner bottle has a neck which is open on the top and extends up though the assembled outer housing. A rigid plastic head piece is fitted onto the outer housing over the neck of the inner bottle, and has an opening therein for the insertion of a straw to drink the contents of the inner bottle.

Although this container allows for the replacement of the inner bottle, it uses a rigid material for the character shape of the outer housing. Also, because rigid materials are used, the three-dimensional detail is relatively rudimentary. Nor can the product be dispensed by squeezing the two-piece, rigid outer housing—it must be poured out of or otherwise removed from the inner bottle. Further, because the inner bottle has the same three-dimensional shape as the outer housing, the inner bottle and outer housing must be used in conjunction exclusively with each other—the inner bottle cannot be used with a differently shaped outer housing, and vice versa.

A need therefore exists for a packaging system which includes a replaceable inner container and a flexible, resilient outer container, the flexible, resilient outer container being decorative and having a three-dimensional shape or form resembling the shape of an animal, a cartoon character, a youngster's toy or the like, and being squeezable to allow for use of a dispensing-type closure on the inner container.

It is therefore an object of the present invention to provide a packaging system for a liquid or powder product which has an external three-dimensional shape, such as a cartoon character or the like, to provide superior aesthetic appeal.

It is a further object of the present invention to provide a packaging system having an outer shell which is constructed from a soft, flexible material, the outer shell being configured in a three-dimensional character shape.

It is a further object of the present invention to provide a packaging system having an inner container which contains the product, the inner container providing a means of separating the product from the soft, flexible material of the outer shell.

It is a further object of the present invention to provide a packaging system which has an outer shell capable of use with a variety of inner-container shapes and sizes, and an inner container which is easily replaced once the liquid or powder product contained therein is consumed.

It is a further object of the present invention to provide a packaging system having a soft outer shell surrounding an inner container, the outer shell being flexible and resilient to allow for squeezing to cause dispensing of the product when a dispensing-type closure is used.

These and other objects and advantages of the invention will become more fully apparent from the description and claims which follow or may be learned by the practice of the invention.

SUMMARY OF THE INVENTION

The present invention is directed to a packaging system. The packaging system comprises an inner container having a body defined by a side wall and an opening therein for dispensing a product contained within the inner container. A flexible outer shell substantially surrounds the inner container and is removably secured thereto. The outer shell can be designed to resemble the three-dimensional shape (or a portion of the shape) of an animal, a cartoon character, a youngster's toy or the like, for superior aesthetic appeal. The contents of the inner container are contained therein with a closure. Optionally, a three dimensional topper may be provided, which may be designed to resemble the head or upper portion of the character being depicted.

The topper can be part of the outer shell, i.e., fixedly attached thereto, or the topper can be a separate component. If the topper and outer shell are one component, the topper is provided with an aperture. The closure of the inner container, when in its open position, is in fluid communication with the aperture, to allow for dispensing of the product. If the topper and outer shell are separate components, the topper can have an aperture, in which case the closure is aligned with or extends through the aperture for dispensing. Alternatively, the topper can have no aperture, in which case the topper must be removed to gain access to the closure to dispense the product.

The inner container can alternatively be housed within a one-piece outer shell having therein an access opening of sufficient size to permit insertion of the inner container into the outer shell. In this instance, the inner container is removed from the outer shell, after which the contents are dispensed from the inner container. Alternatively, the one-piece outer shell can be provided with an aperture, which is adapted to receive or is in communication with the closure of the inner container, to allow for dispensing of the product without the need for removing the inner container from the outer shell.

BRIEF DESCRIPTION OF THE DRAWINGS

The following drawings are illustrative of embodiments of the invention and are not meant to limit the scope of the invention as encompassed by the claims.

DETAILED DESCRIPTION OF THE PREFERRED EMBODIMENTS

In the preferred embodiment, a packaging system is provided which comprises an inner container for holding a product, which is preferably present in liquid or powder form. Surrounding the inner container is an outer shell, which is constructed of a flexible, resilient material. The inner container is sealed with a closure to hold the product therein. The outer shell is designed with a decorative three-dimensional shape, to resemble a child's play figure, animal, cartoon character, toy or the like. A decorative head piece, or "topper," which is also three-dimensional in configuration, may be provided to complete the character's body and enhance the aesthetic appeal of the packaging system.

The inner container can be any type of container, such as a bottle, can, jar, tube, or the like, which typically holds a wide variety of products, from shampoos, bubble baths and soaps, to syrups and liquid beverages, to products, such as baby powder, which come in powdered form. The packaging system of the invention is designed to accommodate any type of conventional container—no special container need be manufactured. The consumer can simply purchase the desired product in its original container, and that container, with its product therein, will serve as the inner container of the packaging system of the present invention.

If the inner container is specially manufactured, it is designed so that the material used to make the inner container is compatible with the product being packaged therein. The volume of the inner container is defined prior to completing the design of the outer shell, because the inner container, while not conforming precisely to the three-dimensional shape of the outer shell, does serve as the basis for the configuration of the outer shell, i.e., the shape of the inner container is related to the shape of the outer shell that is desired. For example, if a tall, cylindrical appearance is desired for the finished packaging system, the inner container will be tall and round. If a long, relatively wide outer shell is desired instead, the inner container will be similarly shaped. This provides a wide range of design options for both the inner container and outer shell, which can be important when a manufacturer is attempting to create a special look or appearance for the product in the marketplace.

Figure 1:
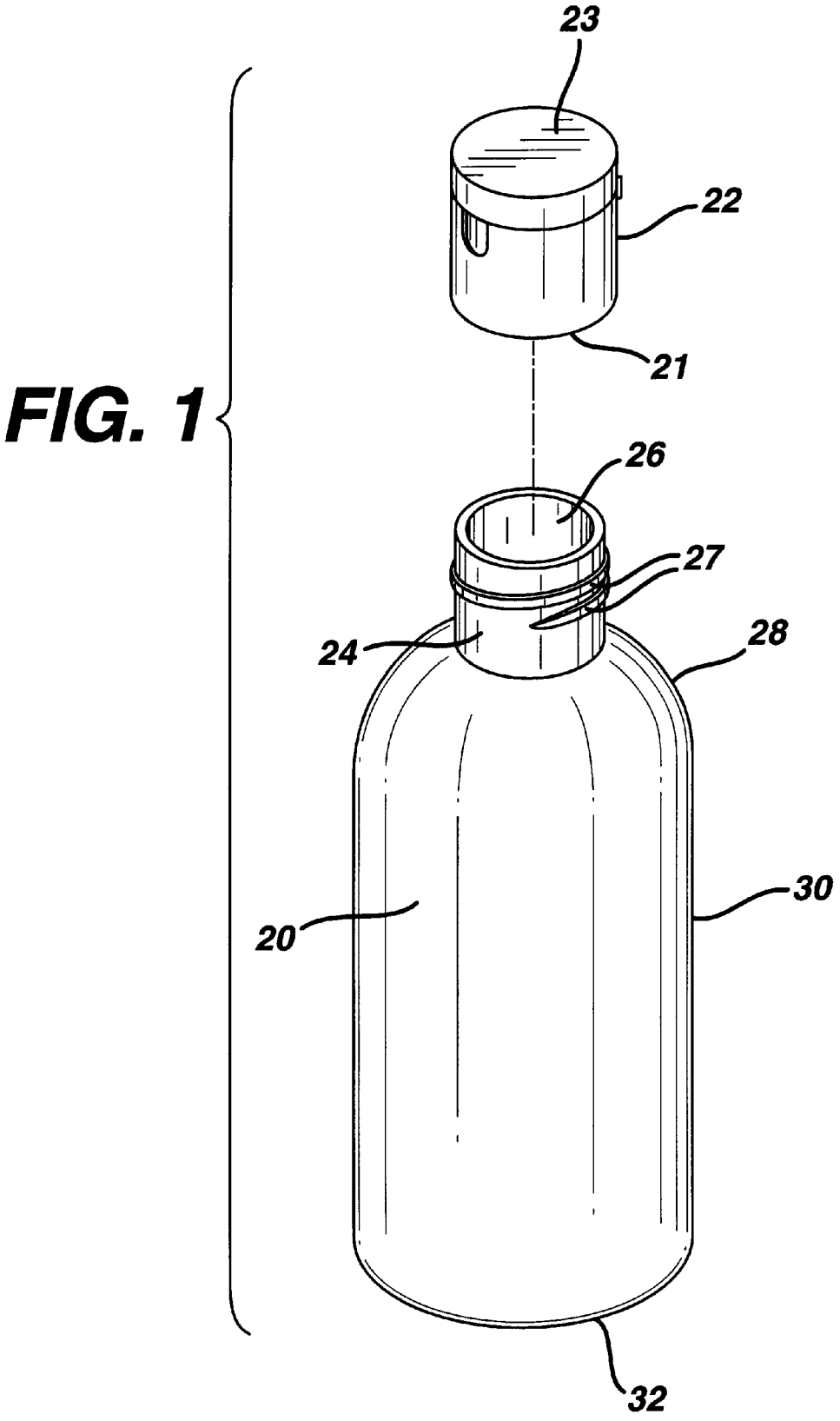
FIG. 1 is a perspective view showing one type of inner container suitable for use in the packaging system of the present invention.

One type of inner container that may be used is shown in FIG. 1. It is to be understood that the present invention is in no way limited to this shape or this type of inner container. Rather, this inner container is merely an illustration of one type of inner container. Referring now to FIG. 1, inner container 20 is provided with a generally elongated, cylindrical shape. Inner container 20 can hold a wide variety of products, such as personal care products (shampoos, lotions, etc.). It will be understood by those skilled in the art that a myriad of products can be stored in inner container 20.

Inner container 20 comprises a cylindrical side wall 30 and a bottom 32 at its lower end. Inner container 20 is generally hollow, and terminates at its upper end in a neck 24. Neck 24 is provided with neck opening 26, and may be provided with snap bead or threads 27. The contents of inner container 20 are retained therein by a closure 22 having a closure top 23.

Figure 11:
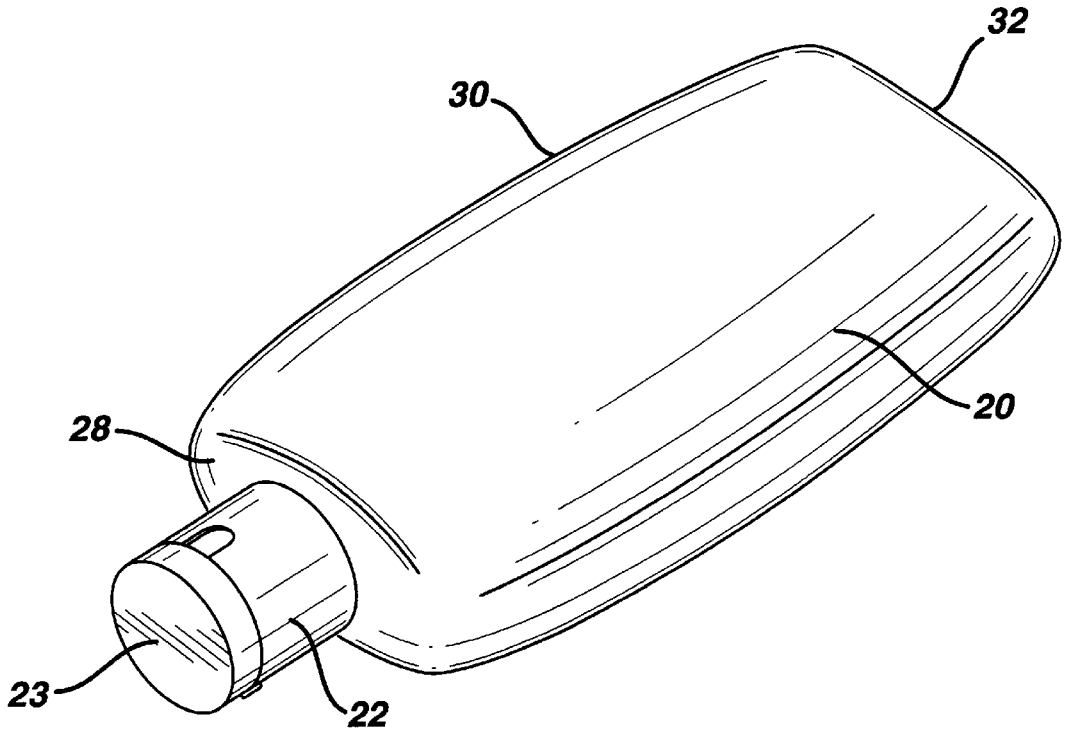
FIG. 11 is a perspective view of an alternate inner container, also suitable for use in the packaging system of the present invention.
Figure 12:
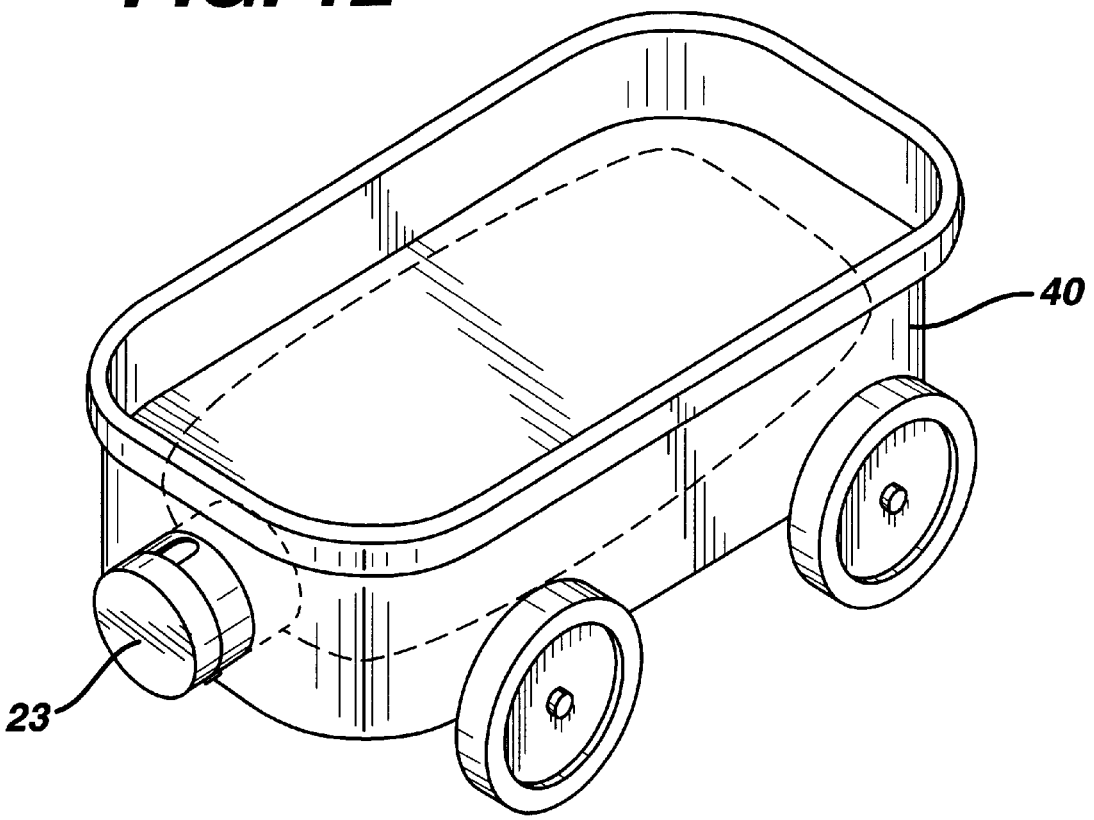
FIG. 12 is a perspective view of the inner container of FIG. 11 positioned within an alternate type of outer shell.

An alternate form of inner container is shown in FIG. 11. This container, rather than being tall and cylindrical, is generally oval in cross section and generally rectangular in front elevation, with rounded portions at the top. Other forms of inner containers may be used in place of the inner containers 20 shown in FIGS. 1 and 11. For example, inner container 20 may be an aluminum can, a glass bottle, a plastic tube, a bottle formed from a rigid material, such as rigid polyvinyl chloride (PVC), etc.

In the preferred embodiment, inner container 20 is a flexible bottle-type container. This type of inner container is preferred, because when the outer shell is placed over the inner container to complete the assembly of the packaging system 10, the flexible nature of the outer shell, combined with the flexibility of the inner container 20, allows the user to squeeze the entire system 10 to effect dispensing of the product from inner container 20. This enables a wide variety of closures to be used with the system, both dispensing and non-dispensing type closures, and provides for the greatest ease in dispensing.

Many types of materials can be used to construct the inner container 20. The choice of materials depends on the product being stored. If the desired inner container is a flexible, bottle-type container, the materials which can be used include, but are not limited to, high density polyethylene (HDPE), polyvinyl chloride (PVC), polypropylene (PP), polyethylene terephthalate (PETE), medium density polyethylene (MDPE), low density polyethylene (LDPE), and the like. These materials enable the inner container to be manufactured with relatively thin walls, providing flexibility to the inner container. The bottle-type inner container can be manufactured using many different techniques, all well known in the art, including but not limited to injection blow molding, extrusion blow molding, stretch blow molding, and rotational molding.

Figure 2:
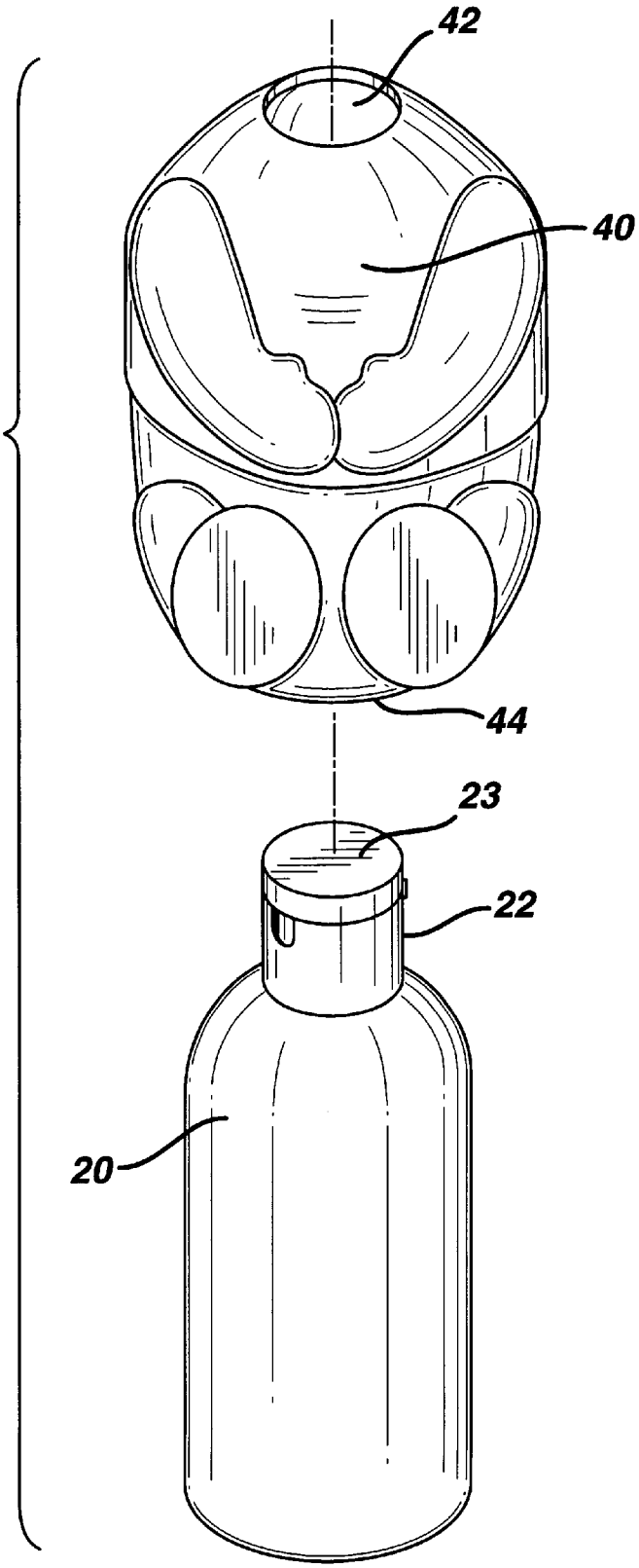
FIG. 2 is a perspective view of the inner container of FIG. 1, showing the outer shell positioned above the inner container prior to placement of the outer shell onto the inner container.

A closure 22 is provided to retain a liquid or powder product within inner container 20. FIG. 1 shows closure 22, which is internally threaded, positioned above externally threaded neck 24 of inner container 20 prior to assembly, and FIG. 2 shows closure 22 threaded onto neck 24 of inner container 20. Any suitable closure known in the art may be used to seal inner container 20. Preferably, a dispensing-type closure is used to take full advantage of the packaging system's flexible, easy dispensing capabilities. A dispensing-type closure is one which traditionally requires the user to first open the closure and then squeeze the container to effect dispensing. Examples of dispensing-type closures include the disk top closure and the flip top closure. The disk top closure requires the user to exert pressure downwardly on one half of the top of the closure, causing the opposite half to pop upwardly, where product can be dispensed through an opening. In the flip top closure, shown in FIGS. 1–8 and 11–14 by way of illustration only, the user simply exerts pressure upwardly on one half of the top 23 of the closure 22, causing the top 23 to flip upwardly, the top 23 being fastened to the closure 22 by a hinge or the like. Product can then be dispensed via an opening in the closure. Other types of closures can also be used, such as a pump-type closure, shown in FIGS. 9 and 10, or a spray-type closure (not shown in the drawings). Other closures which are suitable include continuous thread closures, snap-in closures, or diaphragm dispensing closures. If the product to be contained in the inner container is a beverage, a closure may be provided which has a hole therein, for insertion of a straw.

Packaging system 10 further includes outer shell 40, which fits over and is secured to inner container 20. Outer shell 40 is flexible, meaning that it can be deformed by squeezing. Outer shell 40 is also resilient, meaning that, after it has been squeezed, it recovers to substantially the same shape it had prior to being squeezed. In a preferred embodiment of the packaging system of the present invention, inner container 20 is also flexible and resilient. This allows the user to squeeze the outer shell, and thereby further cause squeezing of the inner container, to effect dispensing of the product from the inner container. Outer shell 40 is provided in a detailed, three-dimensional configuration, to have the appearance of at least a portion, e.g., the body portion, of a cartoon character or animal, etc. The outer shell is constructed from a flexible material, i.e., one which is inherently flexible or which contains one or more plasticizers, to render it flexible, without fear of the product coming into contact with the outer shell and reacting therewith. This is accomplished because the product is contained within inner container 20, and is thereby effectively isolated from outer shell 40. Also, outer shell 40 provides easy replacement of inner container 20 once the product is substantially consumed. This allows the user to simply purchase the decorative portion of the packaging system—the outer shell—one time, and then remove and replace inner container 20 with a new inner container containing the desired product as needed. The user need not purchase the entire three-dimensional package once the product is used, as is true with many of the prior art containers. Nor is it necessary to purchase a refill and then go through the often cumbersome and potentially unsanitary task of dissasembling the package, pouring the refill into the old bottle, and then reassembling the package, as in other prior art devices. Also, outer shell 40 is adaptable to many different sizes and shapes of inner container, and vice versa, providing for an interchangeability feature not present in existing containers.

Outer shell 40 can be constructed from a number of materials, including plasticized PVC resin, silicone resin, LDPE, and HDPE. Plasticized PVC is preferable, as it is easier to handle in the molding process, and is easily decorated, such as by spray painting or the like. The PVC material cures when heated to a given temperature, depending on the specific composition of the PVC. Different manufacturers supply different PVC formulations. The finished shell can therefore be designed to have the desired flexibility and resiliency characteristics by adjusting the concentrations of the various components, especially the ratio of PVC resin to plasticizer(s), in the resin formulation. One suitable PVC resin formulation contains the following components, all of which are commercially available from numerous manufacturers: (a) an emulsion grade PVC; (b) a suspension grade PVC; (c) plasticizers, such as dioctyl phthalate (DOP), diethylhexyl phthalate (DEHP), diisononyl phthalate (DINP), diisoheptyl phthalate (DIHP), and di(2-ethylhexyl) terephthalate (DOTP); (d) stabilizers, and (e) colorants. As is well known in the art, the more plasticizer that is added to the PVC resin, the softer and more flexible the finished part will be. Those skilled in the art will be able readily to select other resin formulations to give the outer shell the described flexibility and resiliency characteristics.

The finished shell preferably has a Type A Durometer hardness of about 50 to about 90 (as measured by ASTM Test Method D 2240-91—Standard Test Method For Rubber Property—Durometer Hardness), more preferably about 60 to about 85, and most preferably about 70 to about 80. Above a Durometer hardness of about 90, the shell is too rigid for satisfactory flexing. Below a Durometer hardness of about 50, the shell tends to be too soft, and presents difficulty during the assembly operation. Particularly when it is made from a plasticized PVC, the outer shell has an appealing feel to it, and is easily molded into a variety of shapes having superior three-dimensional detail, to provide a more realistic shape to the character than that of the prior art containers.

Desirably, outer shell 40 has a wall thickness ranging from about 0.075 inch to about 0.150 inch. However, as would be apparent to a skilled art worker, there will be instances, depending on the materials of construction, processing conditions, the particular three-dimensional configuration selected, etc., in which the wall thicknesses may differ considerably from those mentioned above.

Outer shell 40 is designed and produced through a number of steps, ranging from creative design to molding. Preferably, the outer shell is molded from a PVC plastisol using a rotational molding process, although other processes such as blow molding may be used. The creative work is normally conducted in a clay medium. The medium is placed around the inner container that is being used to hold the product, allowing for the shrinkage of the materials which will occur during the mold production process. The clay is sculpted into the desired three-dimensional shape and is approximately 7% larger than the desired finished part. The final clay sculpture is used to make a master flexible mold, which in turn is used to cast a wax sculpture. The wax sculpture is then sprayed or painted with a coating that conducts electricity, so that the part can be electroplated. Any desired snap or opening designs are added to the sculpture prior to plating, to provide the control needed in the dimensionally-critical areas. After the part is electroplated, the wax is removed by melting, leaving a master rotational mold, which is still approximately 3.5% larger than the final part. This master rotational mold is then used to produce parts that are painted and plated to produce final production molds. Each final production mold is therefore identical, because the inner snaps or openings are pre-machined and inserted exactly the same as the master mold, and the outer shell is made from the master mold.

Once the mold is ready for production, the PVC resin or other chosen material is injected into the rotational mold and a cap is placed over the fill hole. The mold is then heated and rotated to cure the PVC and form a hollow part, i.e., outer shell 40 of the present invention. The mold is cooled and molded outer shell 40 is then removed by pulling it out of the mold. The shell is then subjected to an elevated temperature of approximately 100° C., to remove any distortions in the shell caused by the removal of the shell from the mold. The shell is then decorated, preferably by using spray mask technology, although other methods such as direct printing, pad printing, or transfer printing can be used alone or in conjunction with spray printing.

More than one rotationally molded component can be added to provide special features, such as a head that rotates from side to side, or a hand that waves. Components such as wheels or a bell can be added to the rotational molded outer shell for special effects. These components can be produced using a variety of manufacturing technologies and materials depending on the effects that are desired.

Figure 6:
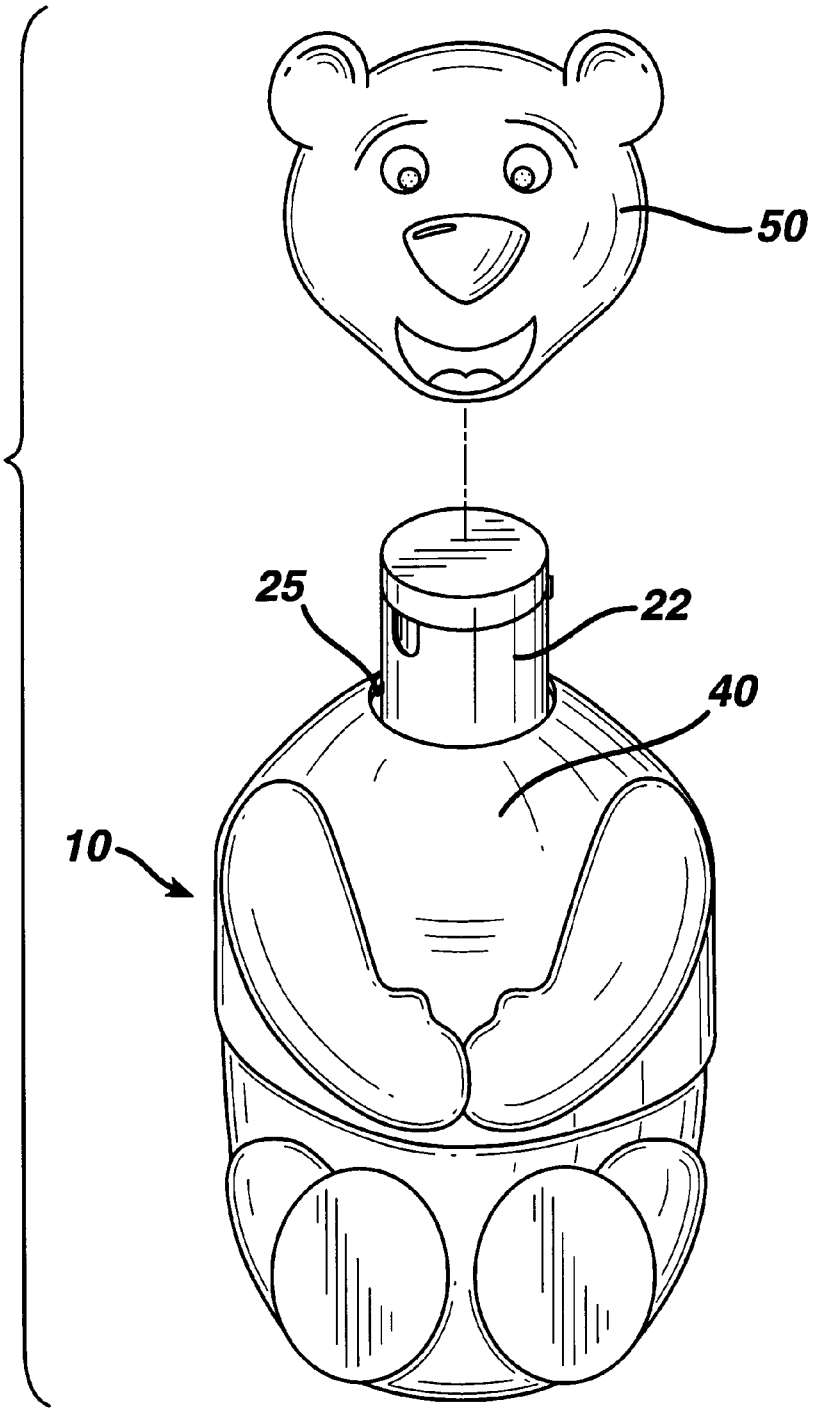
FIG. 6 is a perspective view of a second embodiment of the packaging system of the present invention, showing a decorative topper positioned above the assembled inner container and outer shell prior to placement of the topper.

Referring to FIG. 6, packaging system 10 may, and preferably does, further comprise a topper 50. The optional topper 50 is also preferably made by rotational molding of a plasticized PVC resin. Typically, topper 50 will comprise the head or other portion of the three-dimensional figure comprising packaging system 10. For example, as shown in the drawings, outer shell 40 can be designed to mimic the body of a panda bear, in three-dimensional detail, with arms and legs, etc. Topper 50 would then be designed to portray the bear's head, having ears, eyes, etc. If packaging system 10 were designed to portray a tree, for example, outer shell 40 would resemble the trunk of the tree, and topper 50 would resemble the branches and leaves. It will be understood by those skilled in the art that there are practically an unlimited number of outer shells and/or toppers which can be created, and which fall within the scope of the present invention. The actual three-dimensional figure or character chosen is not critical, and is merely a matter of design choice.

In a first preferred embodiment, shown in FIGS. 1–5, a packaging system 10 is provided which comprises an inner container 20 and an outer shell 40. Closure 22 fits onto neck 24 of inner container 20, to hold the product within inner container 20. It should be understood that closure 22 can take many forms, depending on the type of inner container used. For example, if an aluminum can containing soda or the like is used as the inner container 20, the "closure" would be the pop top or pull tab which typically comes on such a can. Outer shell 40 in the embodiment of FIGS. 1–5 is a one-piece hollow member having an open bottom 44 and a generally centrally located shell opening 42 at its opposite, i.e. top, end.

Figure 3:
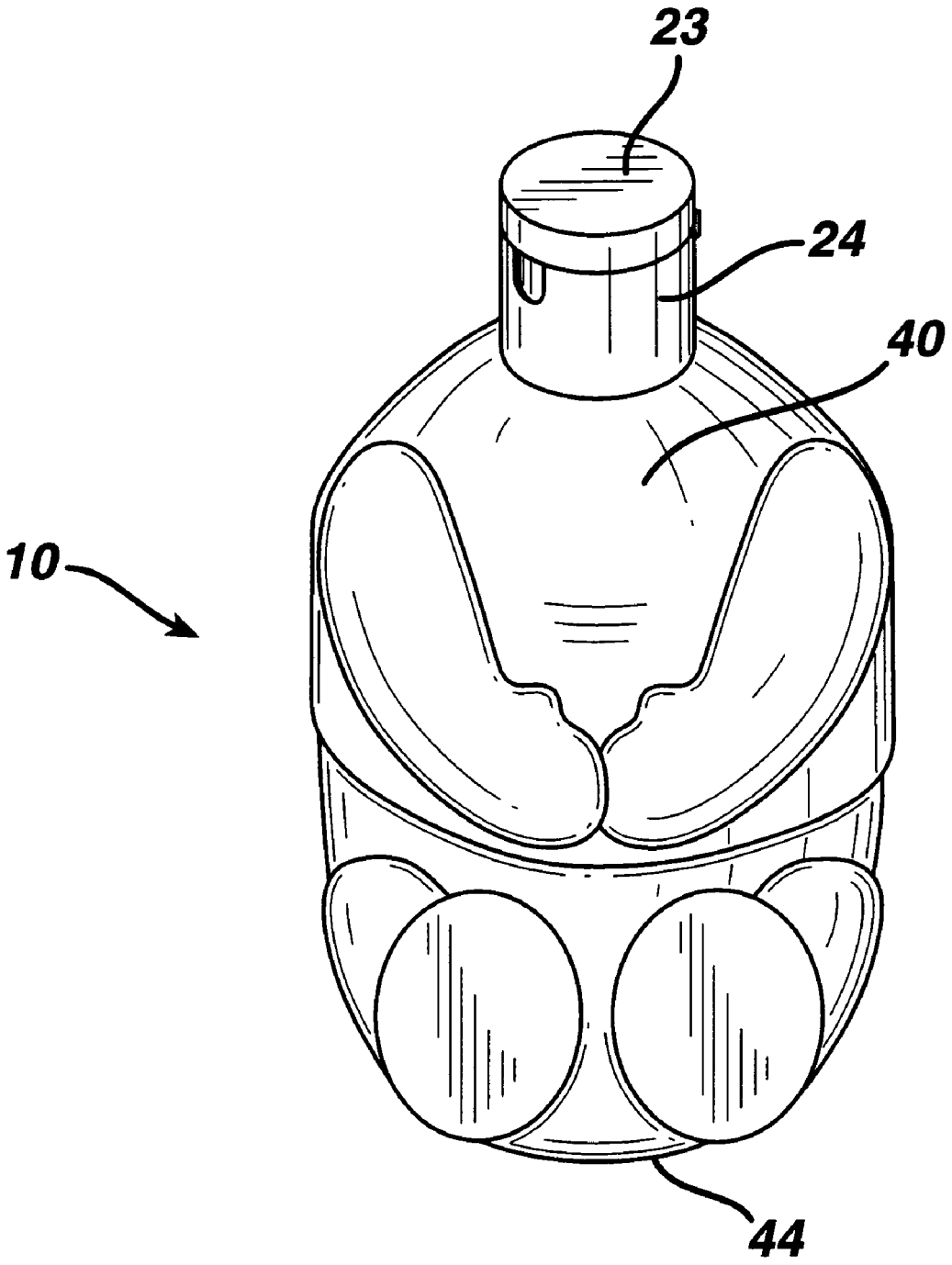
FIG. 3 is a perspective view of one embodiment of the packaging system of the present invention, showing the outer shell assembled to the inner container.
Figure 4:
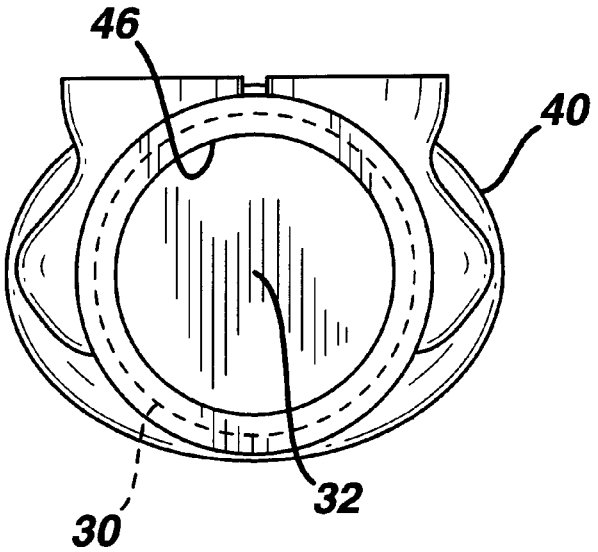
FIG. 4 is a bottom plan view of the packaging system of FIG. 3.
Figure 5:
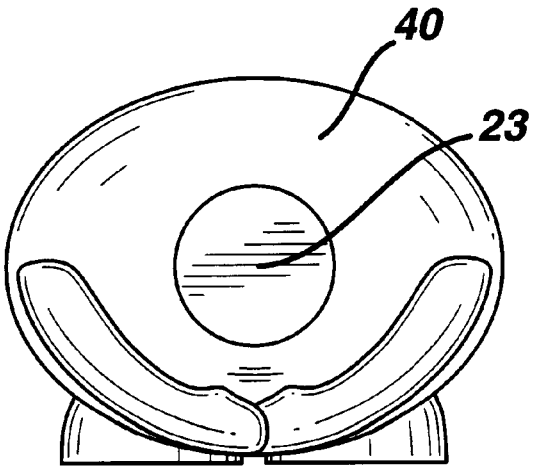
FIG. 5 is a top plan view of the packaging system of FIG. 3.

As shown in FIG. 2, closure 22 is first attached to neck 24 of inner container 20, and then outer shell 40 is placed down over the closed neck of inner container 20 so that closure 22 extends through shell opening 42 as seen in FIG. 3. Outer shell 40 comes to rest on shoulders 28 of inner container 20. As shown in FIGS. 3 and 4, the diameter of shell opening 42 can be designed just slightly larger than the diameter of closure 22, so that outer shell 40 is held in place by a friction fit. Alternatively, outer shell 40 can be held in place by removing the closure 22 on inner container 20, placing outer shell 40 on inner container 20 so that neck 24 extends through shell opening 42, and then fastening closure 22 in place onto neck 24. In this configuration, and assuming the outer diameter of closure 22 at its bottom edge 21 is greater than the diameter of shell opening 42 in outer shell 40, closure 22 holds outer shell 40 in place. To insure an even more secure hold on inner container 20, outer shell 40 may be provided with a retaining flap or flange 46 on the bottom 44 of outer shell 40, as shown in FIG. 4. Because outer shell 40 is made from a flexible material, inner container 20 can readily be inserted into and removed from outer shell 40 as needed. Retaining flange 46 will deflect and yield when inner container 20 is pushed upwardly against retaining flange 46 and into the hollow interior of outer shell 40. Similarly, to remove inner container 20, retaining flange 46 can be manipulated by the user by pulling on flange 46 to flex it downwardly and outwardly to allow removal of inner container 20. Alternatively, in the case where outer shell 40 is friction fitted to closure 22, outer shell 40 may be held in one hand and the inner container may be pushed downwardly with the other hand to eject the bottom portion of the inner container past flange 46. The inner container can then be pulled completely out of outer shell 40.

It will be understood that the embodiment of FIGS. 1–5 does not include a topper. The product is dispensed simply by activating closure 22 to allow for dispensing of the product, whether it be by pushing on a pump-type closure to dispense the product or by unscrewing a screw-type cap to pour out the product. In the drawings, a flip top closure is shown. The top 23 of closure 22 is simply flipped up and product dispensed through an opening in the closure 22. When no topper is used, outer shell 40 will typically embody the entire figure that is being represented. However, for the sake of consistency, a panda bear is shown throughout the majority of the drawings, and therefore, in the first embodiment where no topper is used, the outer shell 40 in FIGS. 1–5 is shown as the body portion of the bear only.

Figure 7:
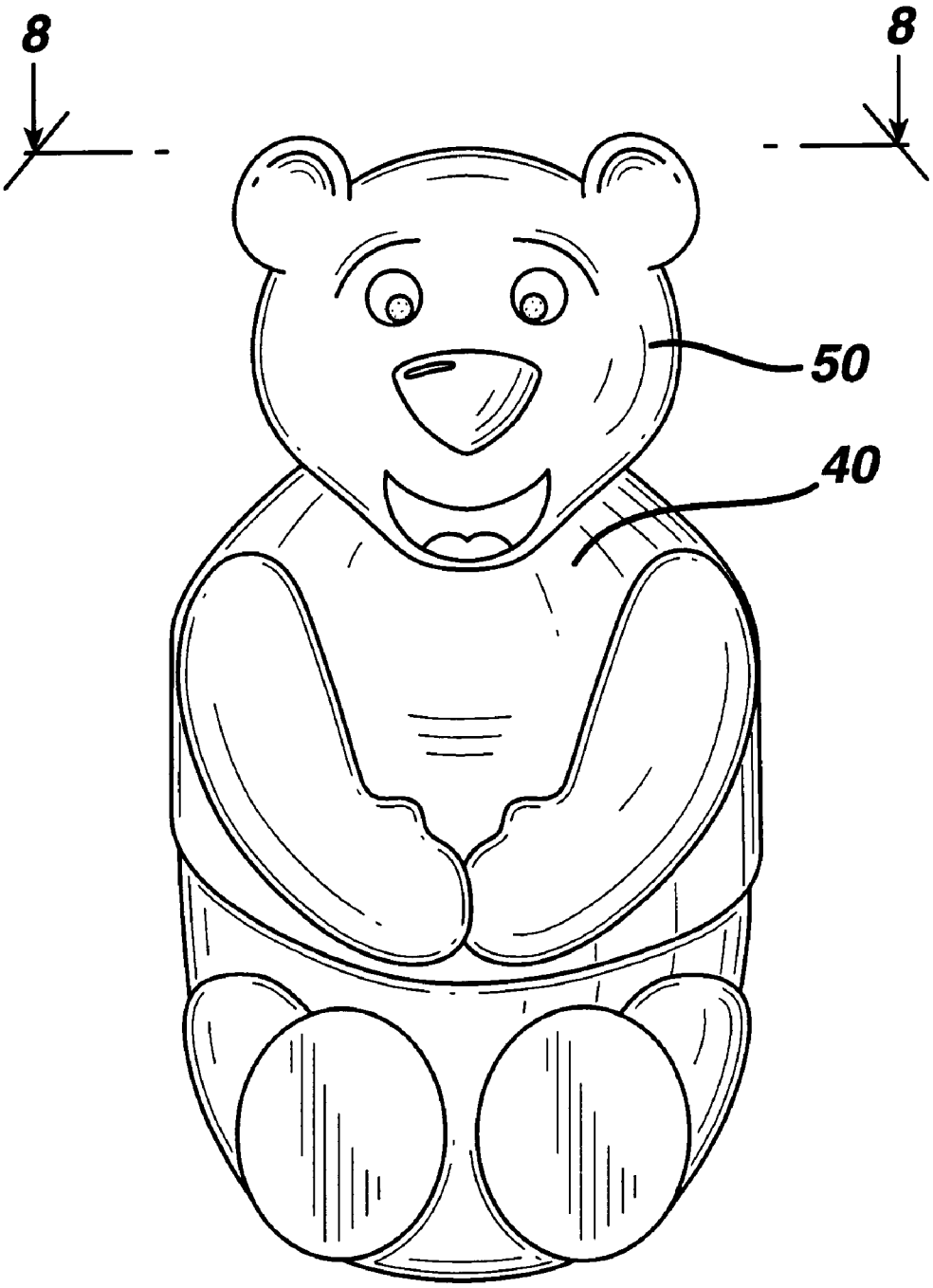
FIG. 7 is a perspective view of the packaging system of FIG. 6, showing the topper in place.
Figure 8:
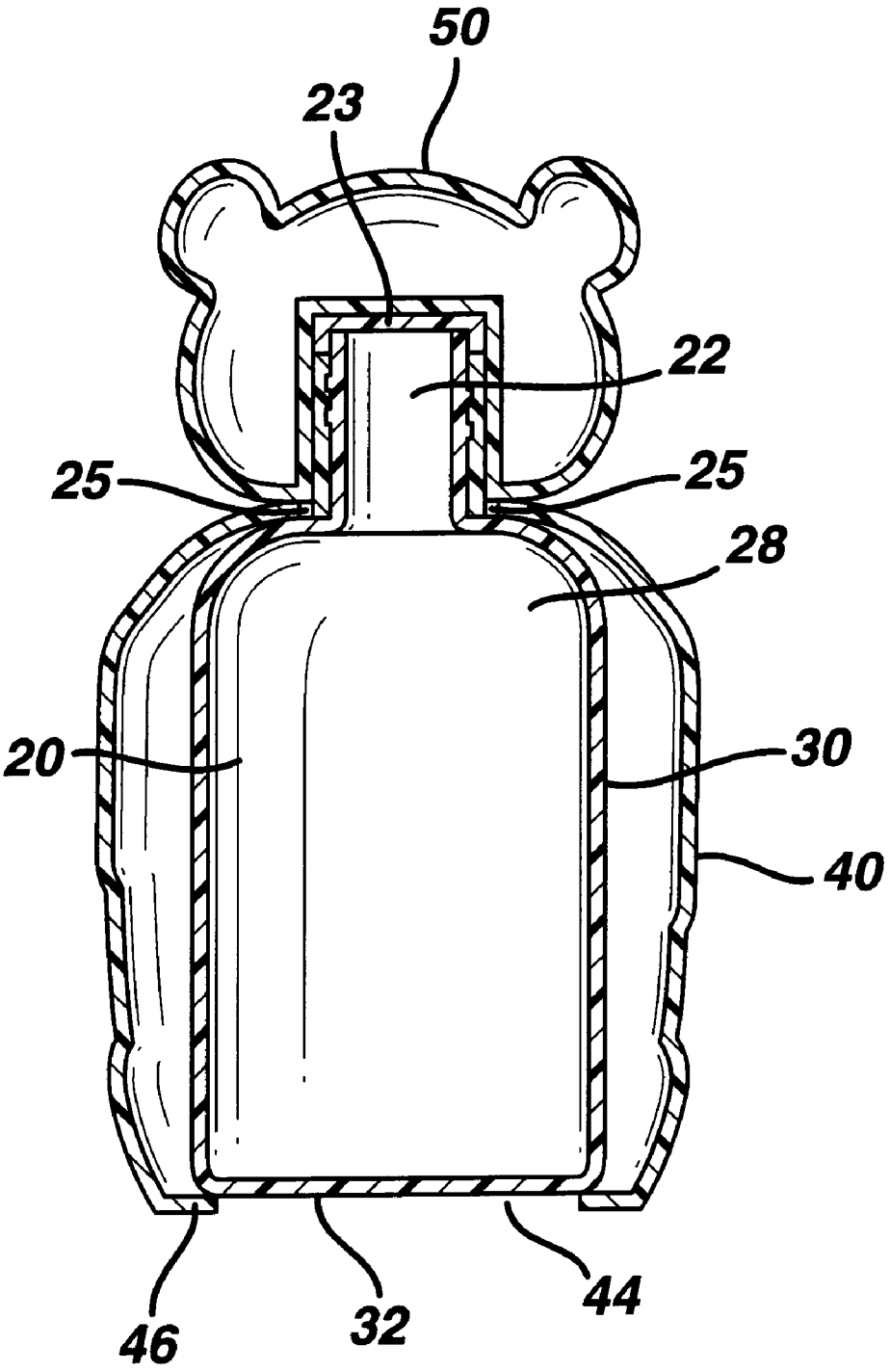
FIG. 8 is a cross-sectional view taken along line 8—8 of FIG. 7.

A second preferred embodiment of the present invention is shown in FIGS. 6–8. Packaging system 10 comprises outer shell 40 secured to inner container 20, as was the case in the first preferred embodiment, with the additional feature that the second embodiment includes a decorative topper 50. FIG. 6 illustrates the placement of outer shell 40 on inner container 20 without a friction fit, although the two pieces can just as readily be friction fitted together if desired. As best seen in FIG. 6, the diameter of shell opening 42 is greater than that of the closure 22, leaving a small gap 25 between shell opening 42 and closure 22. In this embodiment, topper 50 is designed to be placed downwardly over closure 22 of inner container 20, and held in place by a frictional engagement with closure 22, thereby holding outer shell 40 in position over inner container 20. As shown in FIG. 8, when the packaging system is assembled, closure 22 will be positioned within the hollow interior of topper 50. To dispense product, topper 50 is pulled off closure 22, and the product dispensed as previously described. Alternatively, if a screw cap-type closure 22 is used, and topper 50 is adequately secured thereto (either by frictional fit or other means), topper 50 can be turned, thus causing closure 22 to simultaneously be unscrewed from its position on neck 24 and providing access to the product within inner container 20. As can be seen in the drawings, topper 50 is preferably designed to resemble the top or head portion of the character or figure being depicted. However, the actual break point between the topper and the outer shell need not correspond exactly to the break between the head and body of a person or animal. Topper 50 and outer shell 40 can be designed to accommodate a myriad of shapes and characters, which can be separated as topper and outer shell at whatever point on the overall figure is desired (e.g., at shoulder level, at chest level, at waist level, etc.).

Figure 9:
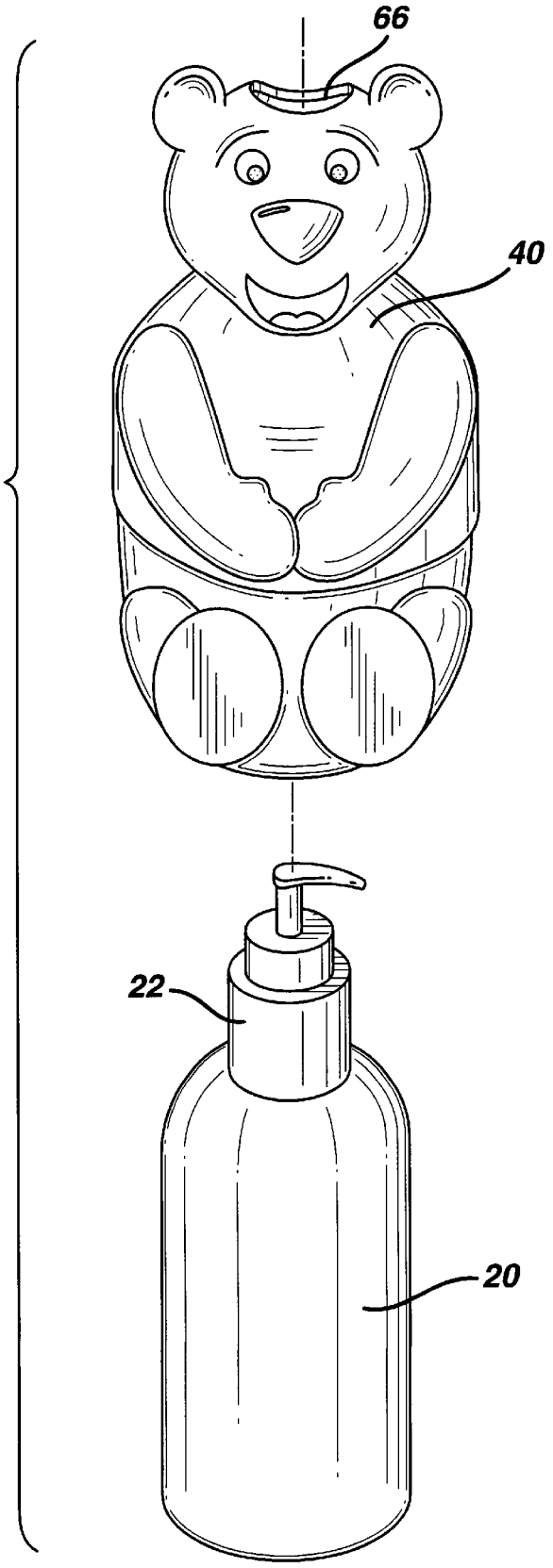
FIG. 9 is a perspective view of a third embodiment of the packaging system of the present invention, showing an alternate form of outer shell, prior to placement on the inner container.
Figure 10:
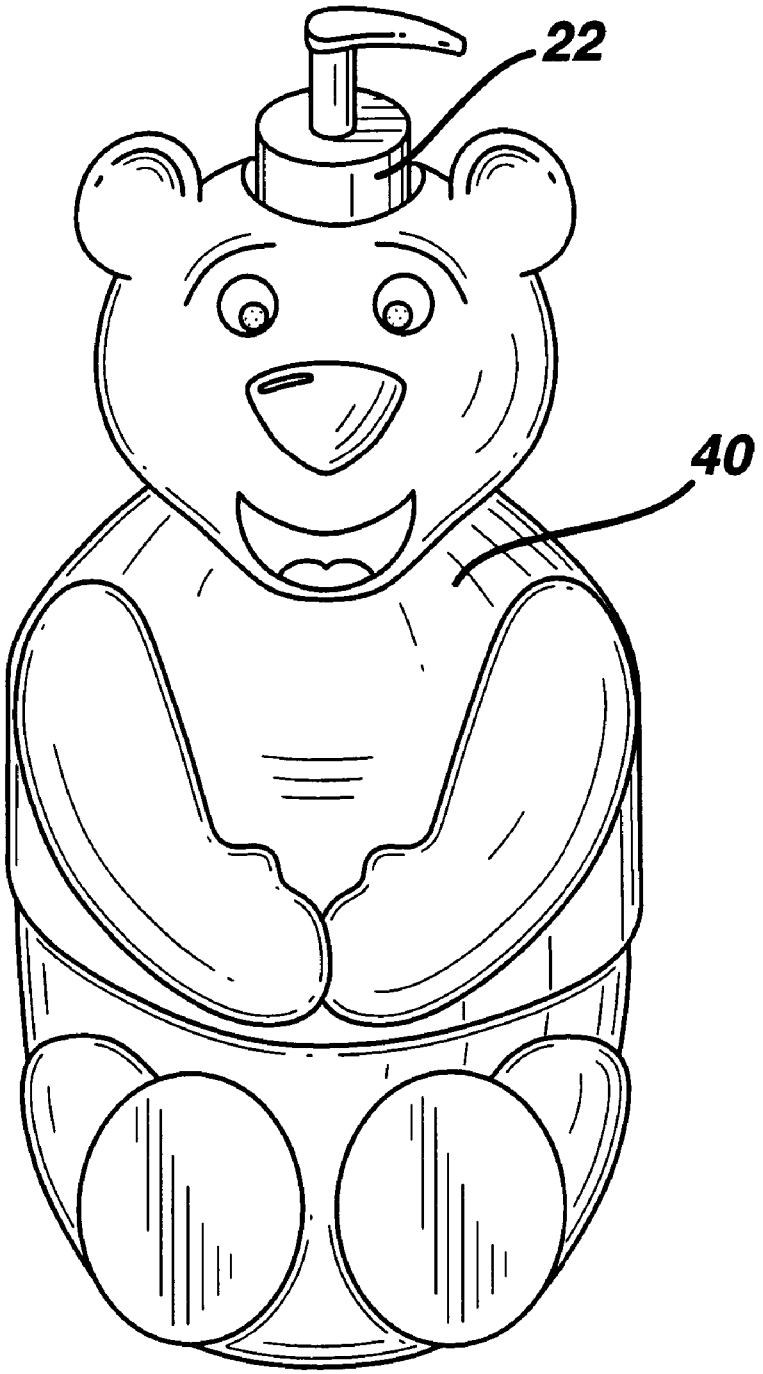
FIG. 10 is a perspective view of the packaging system of FIG. 10, showing the outer shell secured to the inner container.

In a third embodiment of the present invention, shown in FIGS. 9 and 10, a dispenser aperture 66 is provided in the top of topper 50, to allow for projection of at least a portion of the dispensing means, i.e., the closure 22, through topper 50. Topper 50 and outer shell 40 can be two separate pieces, with outer shell 40 being attached to inner container 20 and topper 50 secured over closure 22 as previously discussed, or topper 50 and outer shell 40 can be constructed as one piece. Again, if topper 50 and outer shell 40 are separate components, the dividing point between the two pieces as it relates to the decorative appearance of the three-dimensional character depicted need not necessarily be between the character's head and lower portion of its body, but can be anywhere on the body. If topper 50 and outer shell 40 are one piece, any suitable form of securement of said one-piece to inner container 20, such as friction fitting, may be used.

The embodiment of FIGS. 9 and 10 allows the product to be dispensed without the need for removing topper 50. Because closure 22 protrudes outwardly from topper 50 through dispenser aperture 66, the closure 22 can simply be accessed and activated, such as by flipping the top or pushing the pump, with the topper 50 in place. The pump-type closure is shown in FIGS. 9 and 10 simply to illustrate a different type of closure. Any suitable closure can be used in place of the pump in this embodiment.

Figure 13:
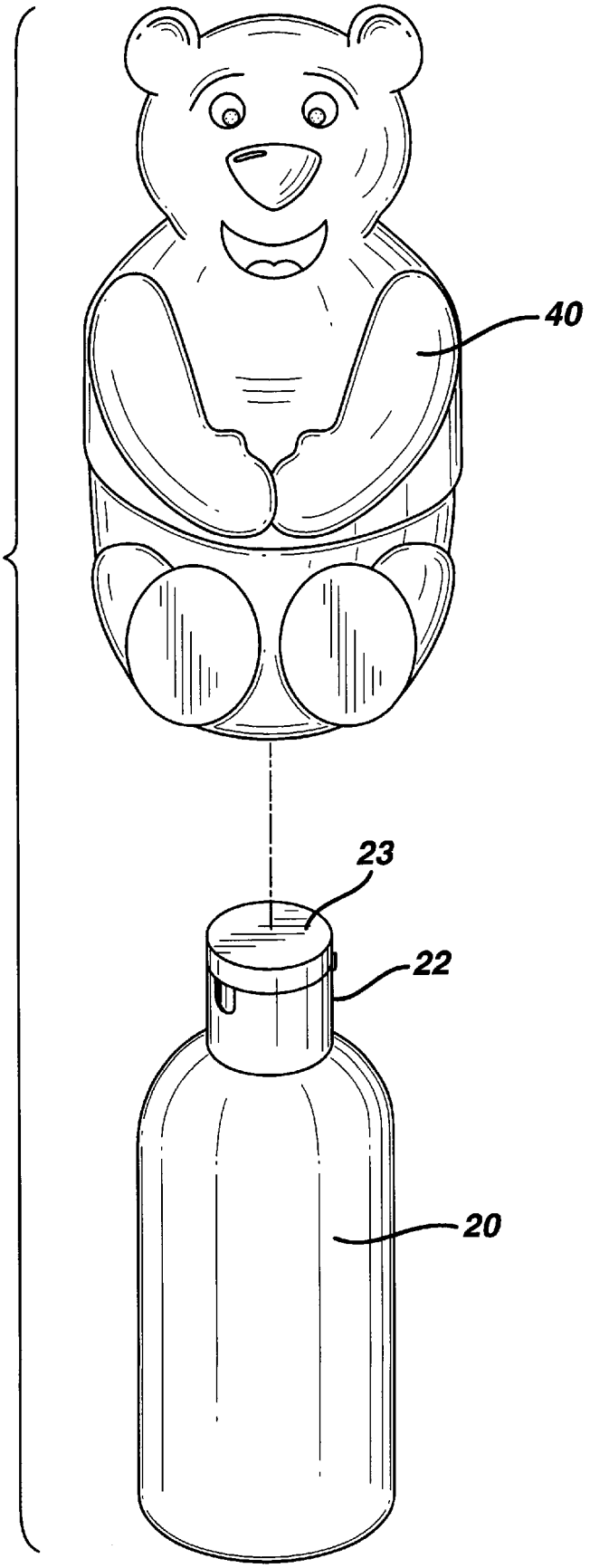
FIG. 13 is a perspective view of a fourth embodiment of the packaging system of the present invention, showing the outer shell positioned above the inner container prior to placement on the inner container.
Figure 14:
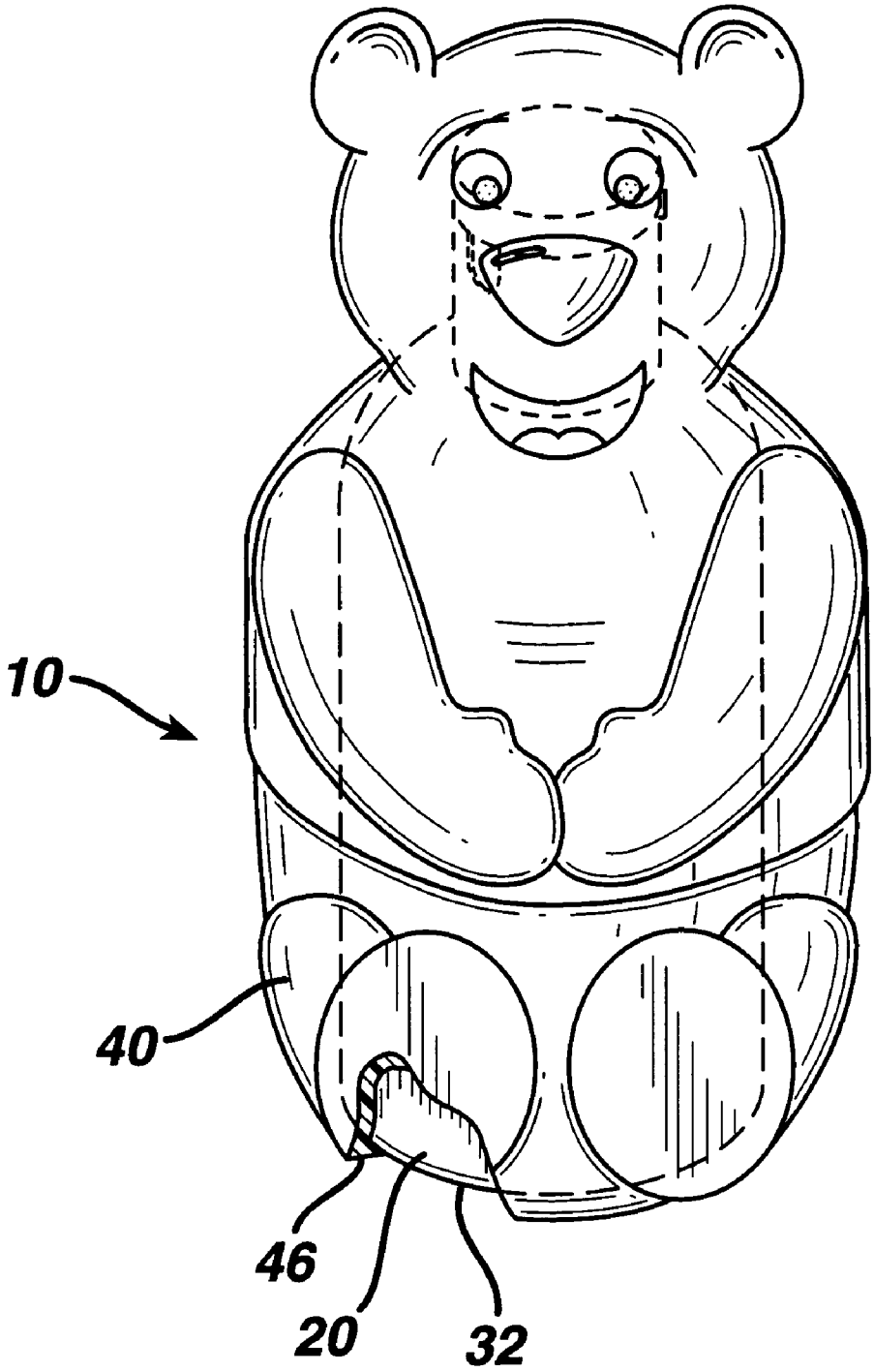
FIG. 14 is a front elevation, with portions cut away, of the packaging system of FIG. 13, the inner container being shown in phantom.

In a fourth embodiment of the present invention, shown in FIGS. 13 and 14, a packaging system 10 is provided which comprises an outer shell 40, in which is housed inner container 20, which contains the product. Outer shell 40 is one piece and embodies the entire three-dimensional body or figure of the character being depicted. Outer shell 40 may be secured to inner container 20 in any suitable manner, such as by friction fitting. In this embodiment, no provision is made for dispensing the product from inner container 20 through outer shell 40. Rather, inner container 20 is instead stored within outer shell 40, and then completely removed therefrom to allow for dispensing. Outer shell 40 can then be used as a child's toy or the like, until storage of inner container 20 is again desired. Retaining flange 46 provides further securement of inner container 20 within outer shell 40.

It is to be understood that although the present invention has been described with reference to a preferred embodiment, various modifications, known to those skilled in the art, may be made to the structures and process steps presented herein without departing from the invention as recited in the several claims appended hereto.

What is claimed is:

1. A packaging system comprising:

(a) an inner container having a resilient side wall;

(b) means for dispensing on said inner container;

(c) a flexible outer shell, said outer shell substantially surrounding said inner container and being removably secured thereto, said outer shell having a shell aperture therein, through which said means for dispensing extends; and (d) a topper affixed to said outer shell, said topper having a dispensing aperture therein, said means for dispensing being positioned within said dispensing aperture in said topper.

2. A packaging system comprising:

(a) an inner container having a body defined by a resilient side wall, said inner container having a first opening therein for dispensing a product contained within said inner container; and (b) a flexible, resilient outer shell, said outer shell substantially surrounding said inner container and being removably secured thereto, and (c) a topper affixed to said outer shell.

* * * * *